US005615996A

United States Patent [19]

Suzuki et al.

[11] Patent Number: 5,615,996

[45] Date of Patent: Apr. 1, 1997

[54] METHOD FOR PREDICTION OF THE PERFORMANCE OF A CENTRIFUGAL PUMP WITH A THRUST BALANCE MECHANISM

[75] Inventors: Kohmei Suzuki, Tokyo; Junichi Kurokawa, Kangawa, both of Japan

[73] Assignee: Nikkiso Co. Ltd., Tokyo, Japan

[21] Appl. No.: 523,218

[22] Filed: Sep. 5, 1995

Related U.S. Application Data

[63] Continuation of Ser. No. 304,135, Sep. 12, 1994, abandoned.

[30] Foreign Application Priority Data

Sep. 10, 1993 [JP] Japan ..... 5-226081

[51] Int. Cl.[6] ..... F04D 17/08

[52] U.S. Cl. ..... 415/1; 415/104

[58] Field of Search ..... 415/1, 104, 106

[56] References Cited

U.S. PATENT DOCUMENTS

| | | | |
|---|---|---|---|
| 3,746,461 | 7/1973 | Yokota et al. | 415/104 |
| 4,415,790 | 1/1984 | Bice et al. . | |
| 4,826,396 | 5/1989 | Blount . | |
| 4,875,178 | 10/1989 | Cook . | |
| 4,886,422 | 12/1989 | Takeuchi et al. . | |

FOREIGN PATENT DOCUMENTS

| | | | |
|---|---|---|---|
| 380280 | 1/1990 | European Pat. Off. . | |
| 1528717 | 10/1969 | Germany | 415/104 |
| 1070340 | 1/1984 | U.S.S.R. | 415/104 |
| 1086232 | 4/1984 | U.S.S.R. | 415/104 |

OTHER PUBLICATIONS

Kurokawa, J., Kamijo, K., Shimura, T., "Axial Thrust Analysis in Lox-Pump", AIAA/SAE/ASM/ASEE 27TH Joint Propulsion Conference, Jun. 24–26, 1991/Sacramento, Ca., pp. 1–9.

Kurokawa, J., Toyokura, T., "Study on Axial Thrust of Radial Flow Turbomachinery", The Second International JSME Symposium Fluid Machinery and Fluidics, Tokyo, Sep. 1972, pp. 31–40.

Kurokawa, J., Sakuma, M., "Flow in a Narrow Gap Along an Enclosed Rotating Disk with Through-Flow", Faculty of Engineering, Yokohama National University, JSME International Journal Series II, vol. 31, No. 2 (1988), pp. 243–251.

*Primary Examiner*—Edward K. Look
*Assistant Examiner*—Mark Sgantzos
*Attorney, Agent, or Firm*—Orrick, Herrington & Sutcliffe, LLP

[57] ABSTRACT

The invention provides a method for predicting the performance of a centrifugal pump with a balance mechanism comprising the steps of assuming leakage amounts in the back of an impeller and a thrust balance mechanism to calculate a flow-rate of the impeller for monitoring a leakage amount of a front and a back of the impeller, calculating a leakage amount in the thrust balance mechanism for judging whether or not a result of the calculation converges, to a set value. If the result does not converge, repeating the steps from the analysis of the flow in the thrust balance mechanism to the calculation of the leakage amount in the thrust balance mechanism. If the result converges, calculating a leakage amount in the pump. If a result of the calculation does not converge, repeating the steps from the calculation of the flow-rate in the impeller until the convergence.

3 Claims, 7 Drawing Sheets

METHOD FOR PREDICTION OF THE PERFORMANCE OF A CENTRIFUGAL PUMP WITH A THRUST BALANCE MECHANISM

This is a continuation of application Ser. No. 08/304,135, filed on Sep. 12, 1994, abandoned.

BACKGROUND OF THE INVENTION

This invention relates to a method for the prediction of performance of a centrifugal pump, and more particularly to a method for the accurate prediction of performance of a centrifugal pump with a thrust balance mechanism by use of a quasi-three-dimensional flow analysis.

A multistage centrifugal pump with an inducer has been widely used for transporting certain dangerous liquids such as LPG, LNG, liquid hydrogen and liquid oxygen. Since the reliability and safety of this pump depends on an axial thrust balance and a leakage seal, it is essential to use an axial thrust mechanism for a dip-type pump or a scanned motor pump, and otherwise to use a complicated shaft seal gear.

It is difficult to use the above-mentioned dangerous liquids to test the performance of this pump. Therefore, a substitute liquid is generally used and actual pump performance is determined by the use of a performance conversion chart. Generally, the pump performance indicated by a non-dimensional amount of liquid is identical among all kinds of liquids, except for the influence of viscosity of the fluid.

For instance, a formula proposed by Moody, Hutton and Ackeret has already been widely used as an extended formula for calculating the influence of the fluid viscosity in a turbine on the non-dimensional performance characteristics. Another well-known method for determining performance conversions for turbines more accurately than that proposed by Moody et al is the JSME standard S-008 issued in 1989.

In a conventional performance prediction analysis of a centrifugal pump or turbine, various losses, which are obtainable by one dimensional analysis, are subtracted from a theoretical pump head to analyze the performance of an impeller. Further, in an analysis of a balance mechanism, such as an analysis of the inside flow, it is assumed that the fluid between a rotary wall and a stationary wall shows a forced vortex motion at half of the velocity of the rotary wall so that friction power and the axial thrust can be analyzed.

In this kind of pump, however, there is less available data to compare a model test with the actual performance. Thus, it is difficult to evaluate the accuracy of the performance conversion.

Conventional performance prediction analysis also has other drawbacks. Due to the use of one dimensional analysis, it is difficult to accurately analyze the flow of the fluid inside the impeller. Thus, there is a large difference between the predicted performance and the observed performance at non-design points. This happens particularly in a low flow-rate region, even if it is possible to predict the performance near the design point. Further, it is difficult to have an accurate grasp of the fluid flow or inertial flow of the fluid in the balance mechanism. This creates a difficulty in evaluating variations of the axial thrust. Further, the leakage characteristics as a function of variations of clearance and the viscosity of the fluid cannot be accurately evaluated.

Further, it is difficult to conduct simultaneous analysis of the impeller and the balance mechanism, both of which are associated with each other, for determining an operating point or a position of the thrust balance mechanism.

SUMMARY OF THE INVENTION

Accordingly, it is an object of the invention to provide a novel method for the prediction of performance of a centrifugal pump with a thrust balance mechanism using a quasi-three-dimensional flow analysis of the inside flow of a treating liquid in an impeller. The method includes the analysis of the reverse flow of the treating liquid near an impeller inlet occurring in a low flow-rate region modeled using the quasi-three-dimension analysis. Flows of the treating liquid in the back and the front of the impeller and the thrust balance mechanism are monitored to determine a range of values to be used to complete the production calculation using a two-dimensional viscosity analysis which incorporates momentum equations. The total performance of a low-specific-speed multistage pump is compared with measured data to accurately predict for all flow-rate regions.

The above and other objects, features, and advantages of the present invention will be apparent from the following descriptions.

In accordance with the invention, there is provided a method for the prediction of the performance of a centrifugal pump with a balance mechanism comprising the steps of obtaining and inputting data relating to the dimension of the pump, the flow-rate, the operational rate of revolution and the liquid characteristics into an analyzer in a conventional manner. Leakage amounts are assumed for the back of the impeller and the balance mechanism in order to calculate the flow-rate of the impeller. This is used to calculate a prediction for performances in pressure and speed. Leakage amounts both in front and back of the impeller and the flow in a static channel are monitored for a range of values for subsequent analysis of the flow of the thrust balance mechanism. The leakage amount in the thrust balance mechanism is calculated to determine whether or not the result of the calculation converges to a set value for operating the centrifugal pump. If the result converges, a leakage amount in the pump is calculated. If the result of the calculation does not converge, the calculation for determining the leakage amount is repeated. The step of calculating the flow-rate in the impeller up through the step of analyzing the inside flow of the impeller as a quasi-three-dimensional potential flow, modeling a reverse flow of a impeller inlet occurring at a low flow-rate to take account at a quasi-three-dimension, and predicting performances of flows in the back and front of the impeller and the thrust balance mechanism by monitoring a range of values combined with a two-dimensional viscosity analysis using a momentum equation are repeated.

In this case, the discharge of the impeller is defined by $$\psi = 2\frac{1-k-\phi\cot\beta_2}{\epsilon_2\cdot\eta_v} - \xi_s - \xi_f$$

$$P_2 = \psi - \frac{v_2^2 - v_1^2}{u_2^2}$$

where k, $\epsilon_2$ and $\eta_v$ are the slip factor, the shrinkage ratio of the impeller channel due to the blade thickness and a volume efficiency respectively, $\xi_f$ is the friction loss and $\xi_s$ is the shock loss respectively. Further, the leakage amount of the pump is defined by $$\eta = \eta_h \cdot \eta_v \cdot \eta_m$$

$$\eta_h = \frac{H}{H_{th\cdot imp} + H_{th,ind}}$$

$$\eta_v = \frac{Q - \Delta Q_{motor}}{Q + \Delta Q_{imp,p}}$$

$$\eta_m = \frac{L_{imp}}{L_{imp} + \Delta L_{f\text{-}\gamma}\Delta Q_{imp,p} \cdot H_{th,ind}}$$

$$L_{imp} = \gamma(Q + \Delta Q_{imp,p}) \cdot (H_{th\cdot imp} + H_{th,ind})$$

where $\eta$ is the total efficiency, $\eta_h$ is the hydraulic efficiency, $\eta_v$ is the volume efficiency, $\eta_m$ is the mechanical efficiency, Q is the flow-rate in a suction portion of the pump, $\Delta Q_{imp,p}$ is the leakage of the front of a shroud clearance in the main impeller, $\Delta Q_{motor}$ is the leakage passing through the balance mechanism and the motor, $(Q-\Delta Q_{motor})$ is the discharge amount and $L_f$ is a disk friction power including a power due to a reverse flow in the impeller inlet.

According to the invention, the inside flow of the impeller is analyzed as a quasi-three-dimensional flow and the reverse flow in the impeller inlet occurring in a low flow-rate region is modeled using quasi-three-dimensional analysis. Flows in the back and the front of the impeller and the thrust balance mechanism are monitored for a range of values by using a two-dimensional viscous analysis using a momentum equation. The total performance of a low specific speed, multistage pump is compared with measured data to accurately predict the pump performance for all flow-rate regions.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

Figure 1:
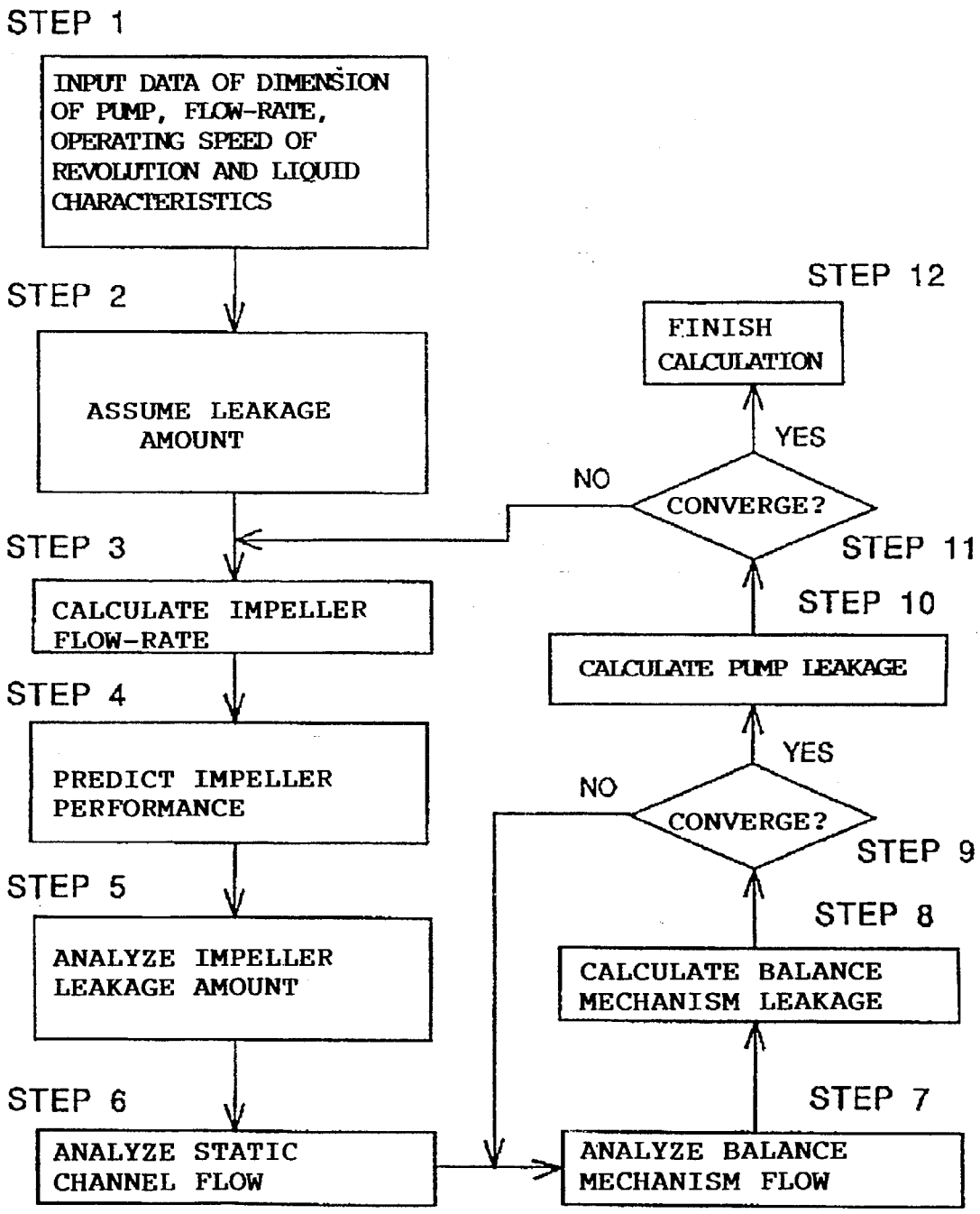
FIG. 1 is a flow diagram showing a computational procedure in an embodiment according to the invention.

A method for the prediction of the performance of a centrifugal pump with a thrust balance mechanism in accordance with an embodiment of the invention will be described with reference to the accompanying drawings.

A performance prediction over the total flow-rate region

An analysis technique for the performance prediction of a centrifugal pump, which takes into account a reverse flow in an inlet and an outlet of an impeller, falls into a one-dimensional detriment analysis of an impeller flow by using results from a quasi-three-dimensional potential flow analysis and an analysis of an impeller outlet flow in a vaneless diffuser channel.

The method for the prediction of the performance concerns an impeller loss which consists of a shock loss and a friction loss, defined by the result of a quasi-three-dimensional analysis, in which a flow separation and a loss induced by second order flow in the impeller channel is shown as a mixing loss in the impeller outlet. This method gives a pressure that is higher than that of a pressure given by conventional methods for measuring impeller loss at the outlet. It has been found that prediction analysis yields results that coincide with empirical observation.

A head coefficient $\Psi$ and an outlet pressure $P_2$ of the main impeller are shown in the form of nondimensional terms defined by $$\psi = 2\frac{1 - k - \phi\cot\beta_2}{\epsilon_2\,\eta_v} - \xi_s - \xi_f \tag{1}$$

$$P_2 = \psi - \frac{v_2^2 - v_1^2}{u_2^2} \tag{2}$$

where k, $\epsilon_2$ and $\eta_v$ are the slip factor, the shrinkage ratio of the impeller channel due to the blade thickness and the volume efficiency, respectively. $\xi_f$ and $\xi_s$ are also defined by the following equations.

The shock loss $\xi_s$ $(=\theta_{is})$ is defined by:

$$\theta_{is} = \frac{\xi_{is}(U_1 - V_{m1}\cot\beta_1)}{U_2} \tag{3}$$

where $\xi_{is}$ defined as follows:

$$\xi_{is} = \begin{cases} 0.6 \sim 0.2\ (\phi \leqq \phi_0) \\ 0.6 \sim 0.9\ (\phi > \phi_0) \end{cases}$$

Further, the friction loss $\xi_f$ $(=\theta_{if})$ is defined by the following equation (See MAY 28–31, 1989, BEIJING 89 SYMPOSIUM-IAHR):

$$\theta_{if(pipe)} = \frac{\lambda(1/4m)\,(w_1^2 + w_2^2)}{2U_2^2} \tag{4}$$

Accordingly, the flow characteristics in a vaneless diffuser channel from the impeller outlet to the diffuser vane inlet are determined by an analysis of the viscosity flow analysis on the basis of a boundary layer theory. It is noteworthy that the friction loss from the impeller outlet to the diffuser inlet is considerably large due to a high peripheral velocity of a low specific speed impeller.

A velocity change along with the streamline of this region is given by an analytical equation, thus determining the pressure by balancing a pressure gradient with a centrifugal force in the direction of a radius, i.e., $dp/dr=\rho v_0^2$.

A fluid loss in the diffuser vane channel consists of a shock loss, a friction loss, and a deceleration loss. The above fluid loss can be estimated by well-known conventional methods.

It is difficult to predict the performance of an inducer, because there is not enough data reported as well as the flow seperation and large second-order flow patterns are observed except for in the region near the design point.

In the multistage pump, the head of the inducer is not so much larger than that of the impeller; thus, the fluid loss can be estimated by adoption of a cascade theory and assuming that the stream surface flow is second order.

A drag coefficient $C_D$ is estimated with reference to the NACA cascade data assuming a thin profile, a small warp and a deflection angle at the outlet in the inducer.

A flow analysis in a thrust balance mechanism

The inventor discovered a relationship between the axial thrust and the leakage of the impeller having a leakage flow in the direction of the radius. It was found that the accuracy of calculating the thrust mainly depends on the flow-rate of the leakage. The flow-rate of leakage is disclosed in "STUDY ON AXIAL THRUST OF RADIAL FLOW TURBOMACHINERY" in the Second International JSME Symposium on Fluid Machinery and Fluidics, Tokyo, September, 1972 and "FLOW IN A NARROW GAP ALONG AN ENCLOSED ROTATING DISK WITH THROUGH-FLOW" in JSME International Journal Series II, Vol. 31, No. 2, 1988.

Since the axial thrust is increased by the pressure affecting the rotating parts of the machinery, the axial thrust consists of the analysis of flow in a clearance (i.e., the space or gap) between the rotary wall, and the stationary wall and the determination of a boundary condition.

Generally, the clearance flow has two types. One type is the axial direction clearance flow between a rotating disk, such as the back shroud of the impeller, and the stationary side. The other type is the ring clearance flow, such as the ring seal. The analysis of the clearance flow and the determination of the boundary condition were reported in and are thus known from "AXIAL THRUST ANALYSIS IN LOX-PUMP" in AIAA/SAE/ASME/ASEE 27th Joint Propulsion Conference Jun. 24–26, 1991/Sacramento, Calif.

The computational procedure

In the prediction of the impeller performance, when the flow-rate is extremely low, the leakage in the clearances in front and back of the impeller shroud vary greatly depending upon the clearance $S_d$ of the balance disk. The clearance $S_d$ is determined from the balance of the force affecting all rotating parts.

Pressure distributions in the clearances between the balance mechanism and the front and back of the impeller are determined as primary approximations which, in turn, are used to determine the extremely precise pump performance and leakage asymptotically.

The inertial leakage of the impeller is analyzed as the quasi-three-dimensional potential flow. The reverse flow at the impeller inlet, which occurs in a small flow-rate region, is modeled to be used in the quasi-three-dimensional analysis.

The two-dimensional viscous analysis using a momentum equation, etc., is combined with the above-mentioned data to establish a composite analysis for a high accuracy prediction of the pumps performance.

A computational procedure will be described with reference to FIG. 1.

In step 1, data relating to the dimension of a pump, a flow-rate, an operating speed of revolution and the liquid characteristics are given. The foregoing are obtained, e.g., measured, in a conventional manner.

In step 2, leakage amounts in back of the impeller and the balance mechanism are assumed. The flow-rate of the impeller is calculated in step 3. In step 4, the impeller performance with respect to pressure and speed are predicted according to the above calculation.

In step 5, the leakage amount in front and back of the impeller is monitored to determine the range of numerical values that can be used for the calculations of the leakage amount of the thrust balance mechanism. In step 6, a static channel flow is monitored to determine the range of numerical values that can be used for the calculation of the leakage amount of the thrust balance mechanism. In step 7, a balance mechanism flow is calculated. In step 8, the leakage amount of the balance mechanism is calculated and in the step 9, it is judged whether or not the result of the calculation, i.e., the leakage amount, converges to an acceptable value to operate the centrifugal pump. When it does not converge, the steps 7 to 8 are repeated. On the other hand, when it converges, a pump leakage is calculated in step 10. If the pump leakage calculation converges, the calculation is complete at step 12. Otherwise, steps 3 to 10 are repeated until the calculation of the leakage amount converges at step 11.

Three types of pumps for transporting LPG and LNG, for which the performance examination was carried out, will be described with reference to the drawings.

Figure 2:
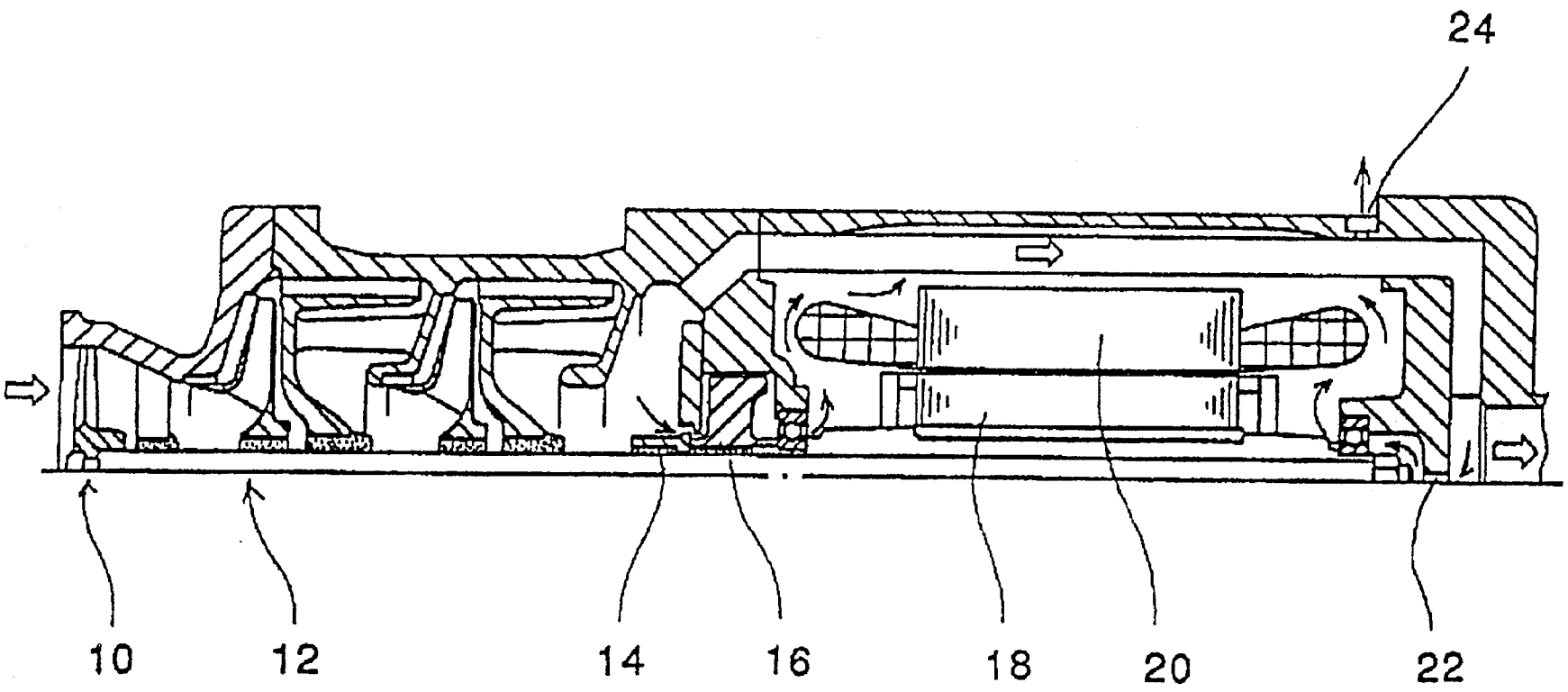
FIG. 2 is a cross sectional view showing a type A pump in an embodiment according to the invention.

FIG. 2 shows a type A pump having specific speed $N_s$ of 143 (m,m$^3$/min, rpm), a main impeller entrance radius $r_1$ of 60 mm, an exit radius $r_2$ of 162 mm, a main impeller entrance angle $\beta_1$ of 26° and an exit angle $\beta_2$ of 22° and $\beta_3$ of 8°.

The type A pump comprises a inducer 10, an impeller 12, a balance disk 14, a balance piston 16, a motor rotor 18, a stator 20, a shaft end orifice 22 and a casing orifice 24.

A liquid passed through the inducer 10 which has four blades as shown in left side of FIG. 2, then passes, the main impeller at the second stage. The fluid is then passed through six pipes provided for surrounding the motor 18 to discharge it from a delivery pipe shown on the right side of FIG. 2.

Figure 3:
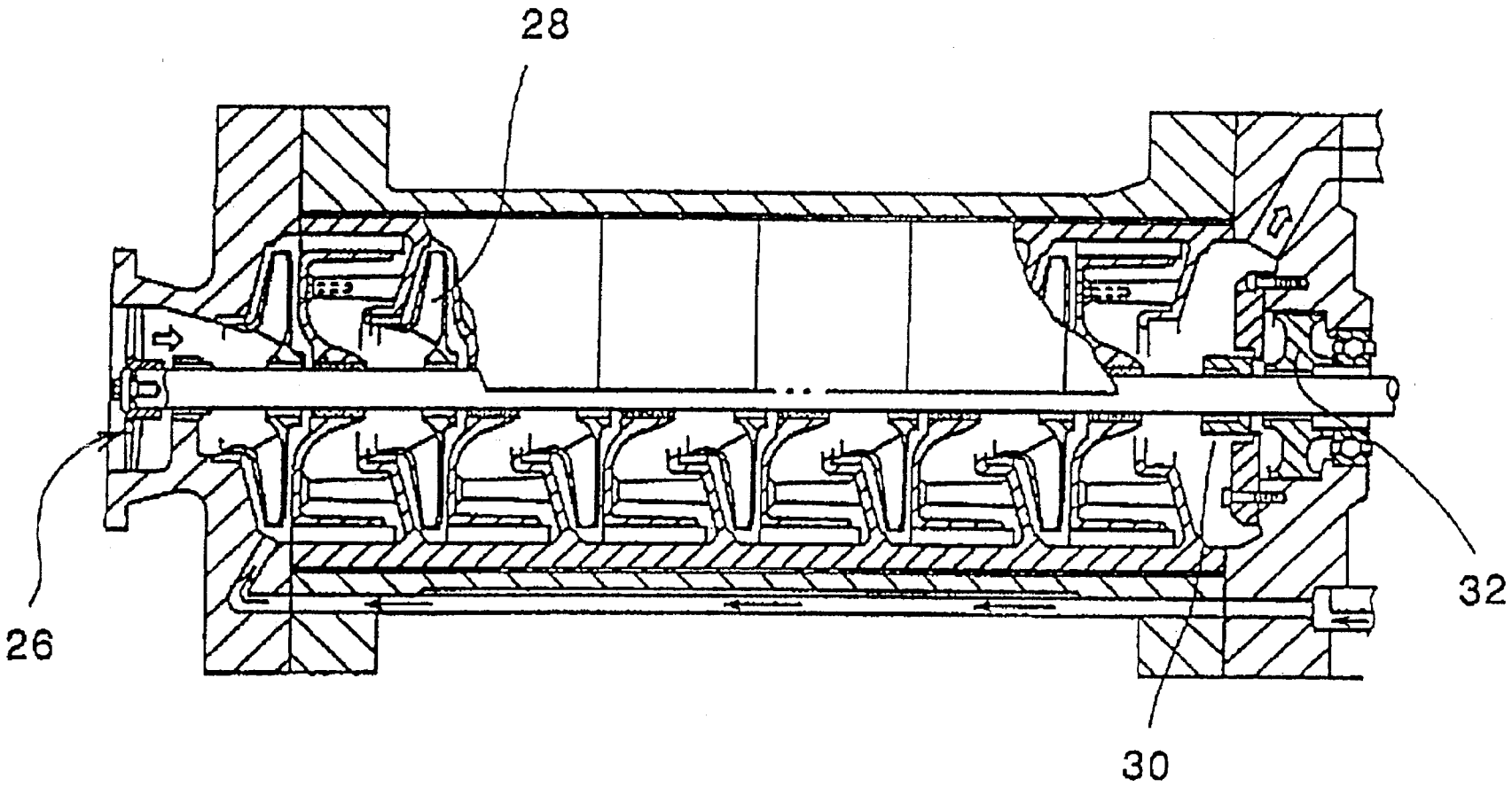
FIG. 3 is a cross sectional view showing a type B pump in an embodiment according to the invention.

FIG. 3 shows a type B pump having a specific speed $N_s$ of 141 (m,m$^3$/min, rpm), a main impeller entrance radius $r_1$ of 57 mm, an exit radius $r_2$ of 143 mm, a main impeller entrance angle $\beta_1$ of 27° and an exit angle $\beta_2$ of 22° and $\beta_3$ of 4°.

The pump shown in FIG. 3 is a multistage pump having two stages or six stages. An inducer 26 is provided at a left side entrance of the pump, which is the same as the type A pump. A large number of main impellers 28 are provided in the rear of the inducer 26. A balance disk 30 is provided on, the left side of a revolving shaft of the pump and a balance piston 32 is provided adjacent to the rear of the balance disk 30.

Figure 4:
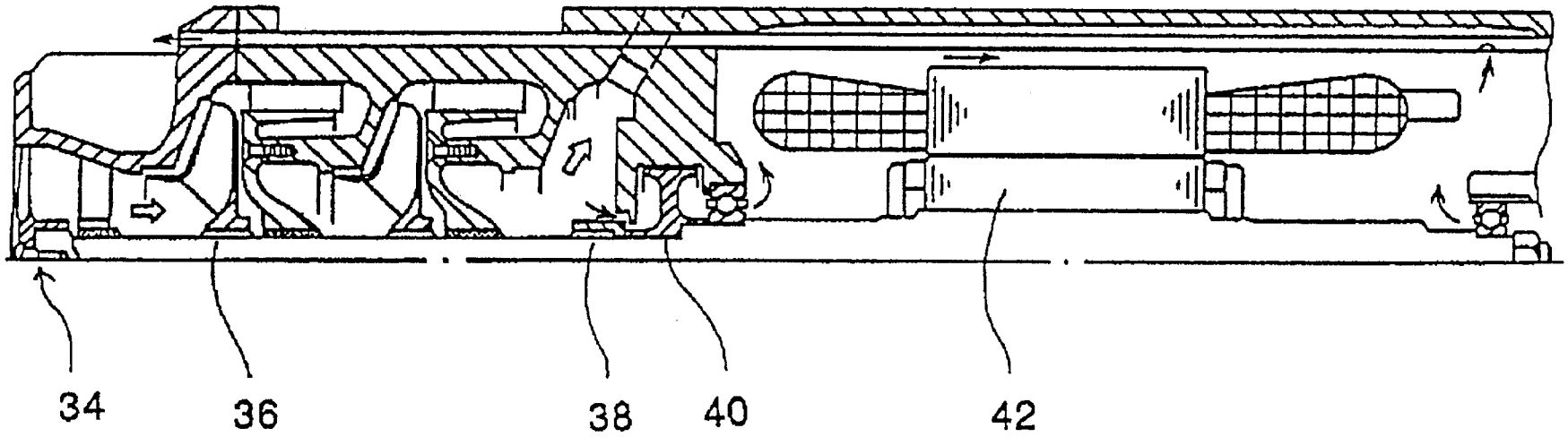
FIG. 4 is a cross sectional view showing a type C pump in an embodiment according to the invention.

FIG. 4 shows a type C pump which is a two stage pump, having a specific speed $N_s$ of 247 (m,m$^3$/min, rpm), a main impeller entrance radius $r_1$ of 58 mm, an exit radius $r_2$ of 136 mm, a main impeller entrance angle $\beta_1$ of the first stage of 27°, an exit angle $\beta_2$ of 16° and an impeller entrance angle $\beta_1$ of the second stage of 28°, an exit angle $\beta_2$ of 22° and $\beta_3$ of 10°, in which each stage is provided with the impeller having a different blade angle.

In FIG. 4, the type C pump comprises an inducer 34, a main impeller 36, a balance disk 38, a balance piston 40 and a motor 42.

Figure 5:
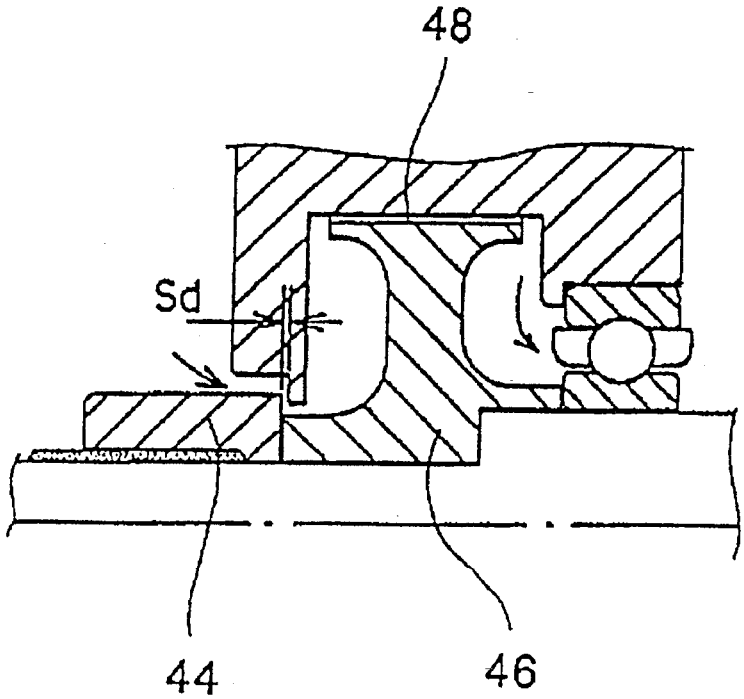
FIG. 5 is a cross sectional view showing a thrust balance mechanism in an embodiment according to the invention.

FIG. 5 shows an enlarged sectional view of the thrust balance mechanism. The thrust balance mechanism comprises a balance disk 44 and a balance piston 46, in which rotating parts including the balance disk 44 and the balance piston 46, which can be moved in the direction of the axis.

In an automatic balance mechanism, the clearance $S_d$ of the balance disk 44 is adjusted to perform an important role determining where the axial thrust is balanced.

In the final step, a part of the liquid in the impeller flows into a balance drum, passing through the balance piston 46 and the balance disk 44, to form a leakage flow from the motor rotor chamber and the casing orifice to a liquid tank or outside of the pump.

For lubrication of the back bearing, the type A pump is provided with another channel from the delivery pipe of the right side via the axial end orifice and the motor chamber to the casing orifice.

In the type B pump, the leakage in the motor chamber is fed back to the exit of the first step via a return tube as shown in FIG. 3. In the type C pump, the leakage in the motor chamber is fed back to the suction opening.

Although the treating liquids are LPG and LNG, water or $LN_2$ are also usable as a test liquid.

Figure 6:
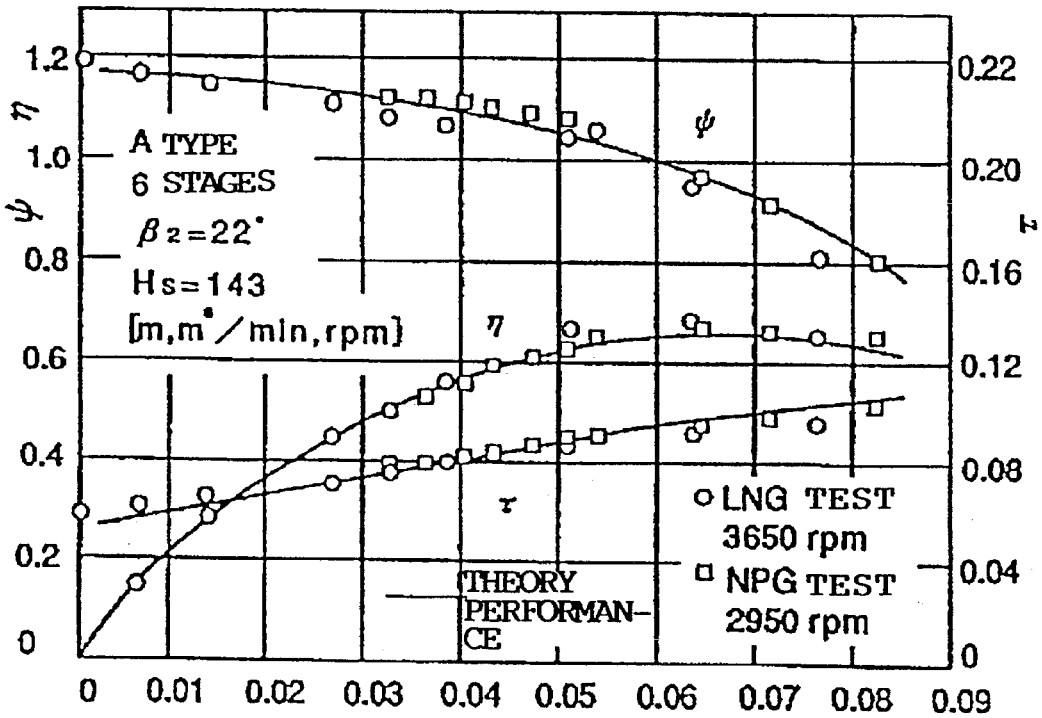
FIG. 6 is a graph showing a performance curve with respect to a type A pump in an embodiment of the invention.

The characteristics of these liquid are shown in FIG. 6 and the Reynolds number according to the peripheral speed and the radius of the impeller is $7\times10^6$ to $4\times10^7$.

A comparison of theory with measured data

Figure 7:
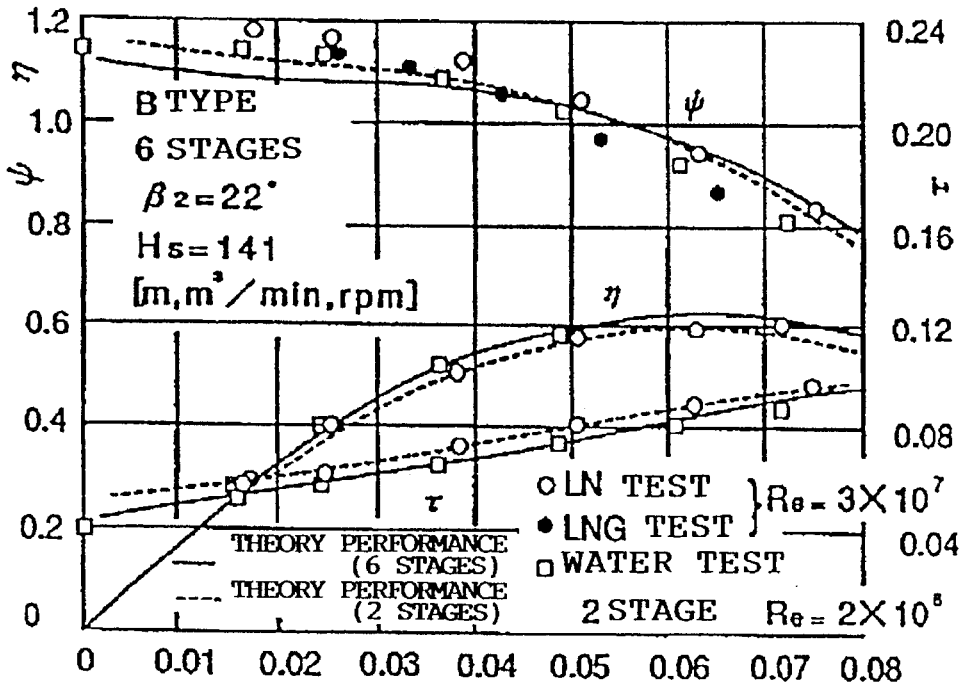
FIG. 7 is a graph showing a performance curve with respect to a type B pump in an embodiment of the invention.
Figure 8:
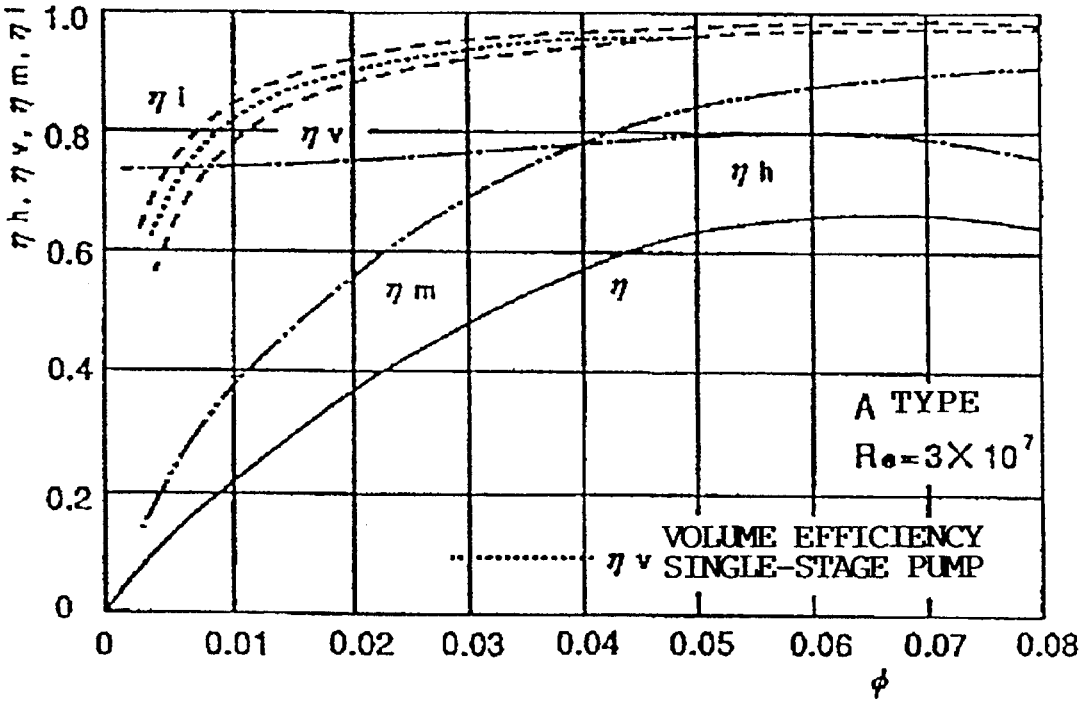
FIG. 8 is a graph showing a predicted performance curve with respect to a type A pump in an embodiment of the invention.

Prediction curves of the head, the axial thrust, and the efficiency are compared with the measured data in FIG. 6, 7 and 8, respectively, which include the performances of the inducer, the main impeller, the diffuser with the vane, the return channel, and the delivery pipe.

The prediction curve corresponds to the measured data in the wide flow-rate range as well as in the vicinity of the design point. Most of the power at a shutoff point depends on the reverse flow at the entrance of the impeller, thus it is further difficult to theoretically predict it. Accordingly, the following equation is used for a shutoff power coefficient $\tau_s$ with reference to Stepanoff's equation and the power according to the reverse flow of the entrance is shown by the second order equation reducing up to 0 at the design flow-rate:

$$\tau_s = 0.137\left(\frac{b_2}{r_2}\right) + 0.0188 + \frac{0.00079}{(b_2/r_2)} \tag{5}$$

In FIGS. 6, 7 and 8, the measurement is carried out about LPG, LNG, $LN_2$ and water, as a result of the measurement, their Reynolds numbers are almost equal thereto, and the measured performance of the pumps is nearly equal except for the type B pump shown in FIG. 7. It is, however, recognized that the measured data differs depending on the liquid used. A shaft power is selected such that the motor operates efficiently in view of the input current and voltage of the motor. Thus, the possibility of difficulty calibrating a dipping former motor remains.

Although the type B pump shown in FIG. 7 is a motor having six stages, measurement by use of water was carried out for two stage pumps. In this case, although the Reynolds number of the six stage pump was used for the calculations, measurement by use of water was carried out only for two stage pumps. As a result of the measurement, the Reynolds number is approximately one-fifth as compared with that of the six stages in $LN_2$ and LPG tests.

In the case of the two stage pump, the contribution of the inducer performance to the whole performance of the pump is relatively large. Thus, the negative head curve of the inducer becomes large.

There is a small error between the measured head curve and the prediction amount. The inducer is provided with a particular large angle at the side of a boss. Another reason for the above error is due to problems in compensating for the head of the inducer in the low flow-rate region.

The total efficiency $\eta$ consists of the hydraulic efficiency $\eta_h$, the volume efficiency $\eta_v$ and the mechanical efficiency $\eta_m$. The reason for the low efficiency of the low-specific-speed pump is clearly seen by the predictions of the total efficiency. The efficiency for a multistage pump with an inducer and a balance mechanism can be defined as follows:

$$\eta = \eta_h \cdot \eta_v \cdot \eta_m \tag{6}$$

$$\eta_h = \frac{H}{H_{th\cdot imp} + H_{th,ind}}$$

$$\eta_v = \frac{Q - \Delta Q_{motor}}{Q + \Delta Q_{imp,p}}$$

$$\eta_m = \frac{L_{imp}}{L_{imp} + \Delta L_f - \gamma \Delta Q_{imp,p} \cdot H_{th,ind}}$$

$$L_{imp} = \gamma(Q + \Delta Q_{imp,p}) \cdot (H_{th\cdot imp} + H_{th,ind})$$

In the above equations, Q is the flow-rate in the pump suction portion, $\Delta Q_{imp,p}$ is the leakage in the front shroud clearance of the main impeller, $\Delta Q_{motor}$ is the leakage passed through the balance and the motor, and the discharge is given by $(Q-\Delta Q_{motor})$. The effects of the back shroud of the main impeller are accounted for when the diffuser vane performance is predicted. $L_f$ is a disk friction power including a power resulting from the reverse flow at the entrance of the impeller.

FIG. 8 shows the efficiency volume prediction of the type A pump. There are some leakage flows passing through both the clearance around impeller and the balance mechanism. Thus, the volume efficiency of the pump is different from that of the impeller. Accordingly, the volume efficiency prediction of the type A pump is shown in FIG. 8 simultaneously with the comparison to the normal single stage pump. FIG. 8 illustrates that the volume efficiency is high as compared with that of normal pump, and the mechanical efficiency is low on account of the high power which is consumed by the rotating parts of the balance mechanism.

The hydraulic efficiency is not low because the presence of the inducer increases hydraulic efficiency.

The influence of the viscosity in the pump performance

In the type A pump, the Reynolds number is varied in the range of $5\times10^5$ to $5\times10^8$ to demonstrate the influence of the viscosity. The prediction calculation is then carried out. As a result of the calculation, it is shown that the total efficiency is increased by changing the Reynolds number. This is chiefly due to the lowering of the shaft power.

Generally, it is expected that the head coefficient is increased by the reduction of the friction of the wall if the Reynolds number is increased. Although the friction loss coefficients of the impeller and the diffuser channel are actually decreased as expected, the friction loss of the wall between the exit of the impeller and the entrance of the diffuser is increased. Since an absolute velocity of those portions is particularly large in the low specific speed pump, the friction loss coefficient of those portions occupies the greater part of the total fluid loss.

According to the theory, if the thickness of a boundary layer is decreased, the Reynolds number is increased. Thus, the friction loss coefficient is increased by the influence of roughness of the casing wall surface. This is larger than the decrease of the friction loss coefficient at the impeller and the diffuser vane channel.

Accordingly, it is suggested that it is important for the pump efficiency to fluidly and smoothly dress the casing wall surface of the exit of the impeller.

Even if it seems that the flow-rate coefficient of the best efficiency point (BEP) is only changed on the basis of a large change in the Reynolds number, the shaft power coefficients of the best efficiency and the BEP are changed greatly. In addition, the performance obtained by the use of an alternative liquid such as water and LNG is changed because of a small difference in the Reynolds number, as compared to the case when using dangerous liquids such as LPG and LNG.

The axial thrust performance

As described above, the axial thrust is rapidly changed in accordance with the clearance $S_d$ at a possible balance. Therefore, a change in the clearance is calculated and the result of the calculation is shown in FIG. 9.

Assuming that the thrust which points toward the delivery side (upper side in the actual mounting position) is a positive, the axial thrust and the leakage are considerably decreased in the region of the clearance $S_d$<0.1 mm and only changed in the wide region of the clearance $S_d$.

Figure 9:
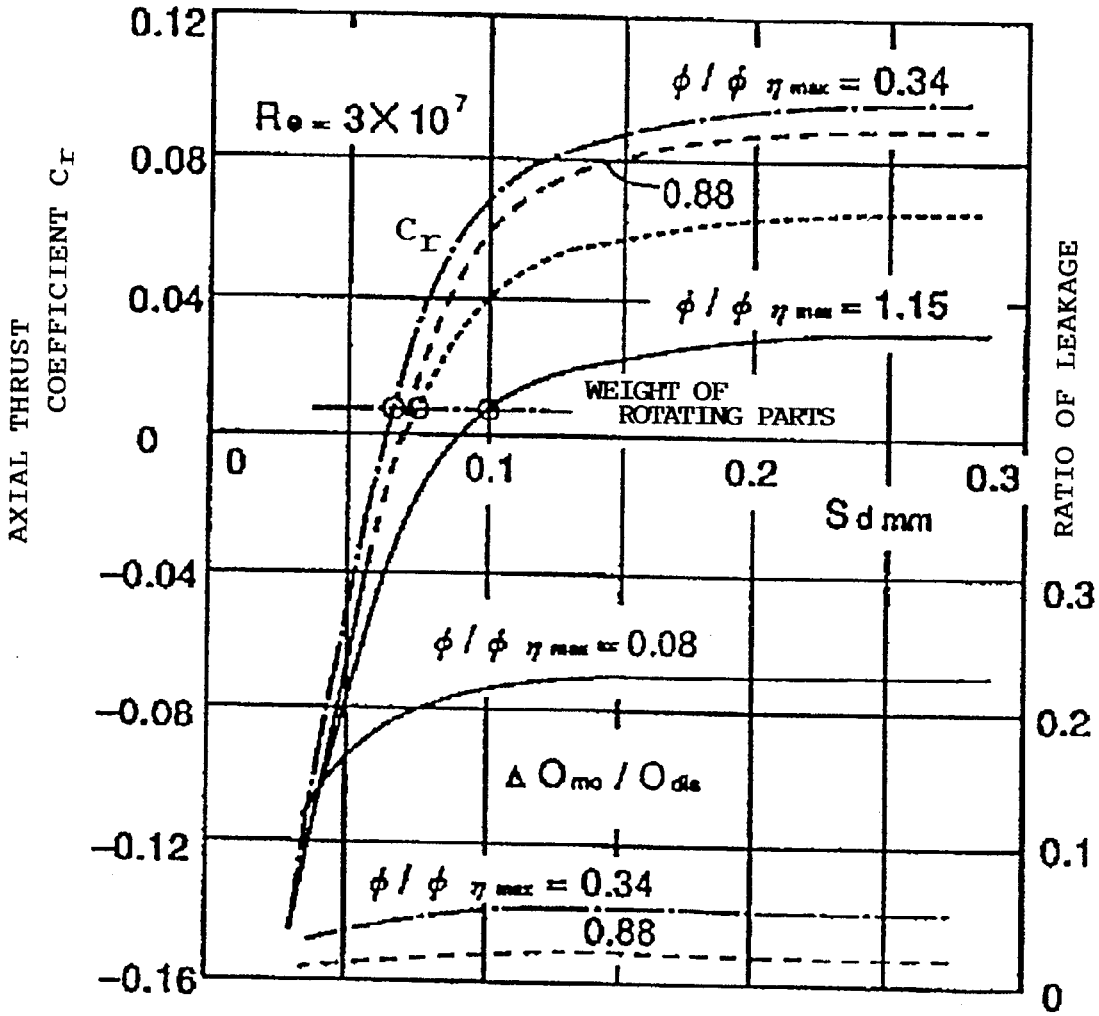
FIG. 9 is a graph showing a performance curve of a thrust balance with respect to a type A pump in an embodiment of the invention.

The clearance in an operation can be found from an intersection of the thrust curve and the rotor weight as shown in FIG. 9. FIG. 9 teaches that the balance mechanism is safely driven at a clearance $S_d$ of approximately 0.07 mm, almost in the design point flow-rate region and approximately 0.1 mm in the high flow-rate region, and that the axis changes very little despite an extensive change of the axial thrust.

A safety of the thrust balance mechanism can be estimated by a slope of $dC_r/dS_d$ in the thrust curve. As a result, a force of approximately 40 tons is required to displace the axis 0.1 mm at point of $C_r$=0.

This shows that this apparatus has a strong rigidity and has a stability against a change in thrust. In the high flow-rate, however, the axial thrust curve is loose and the rigidity decreased.

The contents of symbols used in the above equations are shown in the following.

$b_2$=impeller outlet width $C_r=T/4\rho\pi r_2^2$: axial thrust coefficient (T=axial thrust)

$N_s$=pump specific speed [m,m$^3$/min,rpm]

$P=2p/\rho u_2^2$: nondimentional pressure

Q, ΔQ =pump flow-rate, leakage flow-rate $r_1$, $r_2$=radius of main impeller inlet and outlet $R_e=r_2u_2/\nu$: Reynolds number $S_d$=clearance of axial direction of balance disk $u_2$=main impeller peripheral speed $\beta_2$=main impeller outlet angle η=efficiency $\psi=H/(u_2^2/2g)$ υ, ρ=density of kinematic viscosity of fluid (γ=ρg)

$\tau=L/\rho A_2^3$: power coefficient (L=power, $A_2=2\pi r_2 b_2$)

$\phi=Q_{discharge}/A_2u_2$: pump flow-rate coefficient

As described above, the inside flow of the impeller is analyzed by use of the quasi-three dimensional flow to obtain flow characteristics in the average of the impeller outlet. The impeller boundary layer is analyzed by use of the averaged flow characteristics to obtain the friction loss. The loss of the impeller outlet diffuser and the diffuser boundary flow are obtained by analysis of the impeller outlet diffuser boundary layer, thus predicting the shock loss of the diffuser.

Accordingly, the impeller flow and loss can be analyzed without use of an experimental coefficient and also the difference of the impeller having an arbitrary configuration can be estimated.

In the invention, the loss according to the separation in the impeller and the second order flow appears as the bias of the impeller outlet flow and this when subjected to a homogeneity appears as a mixing loss.

Since the impeller inlet reverse flow, which occurs at the low flow-rate, is modeled for analysis by the quasi-three dimensional analysis, a highly accurate performance prediction can be carried out in the entire region from the low flow-rate to the excessive flow-rate.

Further, the flows at the back of the impeller and the balance mechanism are analyzed by the two-dimensional viscosity analysis using the momentum equation. Thus, the flow analysis which takes into account the changes of all dimensions of each part in detail, can be carried out. Therefore, the axial thrust characteristic of the automatic balance mechanism, the friction loss power, and the leakage characteristic can be estimated with a high accuracy in any mechanism.

The total analysis, combined with the impeller boundary layer analysis, the impeller outlet diffuser boundary layer analysis, and the two-dimensional viscous analysis using the momentum equation are established, according to which the total head of the pump, the shaft power, the efficiency and the axial thrust can be predicted with a high degree of accuracy in all flow-rate regions, thereby making the change of the pump performance and the axial thrust performance according to the viscousness clear.

Whereas modifications of the present invention will no doubt be apparent to a person of ordinary skill in the art to which the invention pertains, it is to be understood that the embodiments shown and described by way of illustration are by no means intended to be considered in a limiting sense. Accordingly, it is to be intended to cover all modifications of the invention which fall within the spirit and scope of the invention.

What is claimed is:

1. A method for predicting the performance of a centrifugal pump with a thrust balance mechanism comprising the steps of:

inputting data relating to pump dimensions, a flow-rate, an operational rate of revolution and liquid characteristics into an analyzer;

assuming leakage amounts in a back of an impeller and said thrust balance mechanism to calculate a flow-rate of said impeller for carrying out a prediction of performance in pressure and speed of said flow-rate of said impeller;

analyzing both leakage amounts in front and back of said impeller and a flow in a static channel for subsequent analysis of a flow of said thrust balance mechanism;

calculating a leakage amount in said thrust balance mechanism for judging whether or not a result of said calculation converges;

if said result does not converge, repeating said steps from said analysis of said flow in said thrust balance mechanism to said calculation of said leakage amount in said thrust balance mechanism;

if said result converges, calculating said leakage amount in said pump;

if a result of said calculation of said leakage amount does not converge, repeating said steps from said calculation of said flow-rate in said impeller up to said convergence for analyzing an inside flow of said impeller as a quasi-three-dimensional potential flow and modeling a reverse flow of said impeller inlet occurring in a low flow-rate using a quasi-three-dimension, analysis; and predicting performances of flows in said back of said impeller and said thrust balance mechanism by a total analysis combined with a two-dimensional viscous analysis by using a momentum equation.

2. A method for predicting the performance of a centrifugal pump with a thrust balance mechanism according to claim 1, wherein said calculation of said flow-rate of said impeller is defined by $$\psi = 2\frac{1 - k - \phi\cot\beta_2}{\epsilon_2 \cdot \eta_v} - \xi_s - \xi_f$$

$$P_2 = \psi - \frac{v_2^2 - v_1^2}{u_2^2}$$

where k, $\epsilon_2$ and $\eta_v$ are the slip factor, the shrinkage ratio of an impeller channel due to a blade thickness and the volume efficiency respectively as well as $\xi_f$ is the friction loss and $\xi_s$ is the shock loss.

3. A method for predicting the performance of a centrifugal pump with a thrust balance mechanism according to claim 1, wherein said calculation of said leakage amount of said pump is defined by $$\eta = \eta_h \cdot \eta_v \cdot \eta_m$$

$$\eta_h = \frac{H}{H_{th\cdot imp} + H_{th,ind}}$$

$$\eta_v = \frac{Q - \Delta Q_{motor}}{Q + \Delta Q_{imp,p}}$$

$$\eta_m = \frac{L_{imp}}{L_{imp} + \Delta L_{f\text{-}\gamma}\Delta Q_{imp,p} \cdot H_{th,ind}}$$

$$L_{imp} = \gamma(Q + \Delta Q_{imp,p}) \cdot (H_{th\cdot imp} + H_{th,ind})$$

where $\eta$ is the total efficiency, $\eta_h$ is the hydraulic efficiency, $\eta_v$ is the volume efficiency, $\eta_m$ is the mechanical efficiency, Q is the flow-rate in a suction portion of said pump, $\Delta Q_{imp,p}$ is the leakage of a front of a shroud clearance in said impeller, $\Delta Q_{motor}$ is the leakage passing through said balance mechanism and a motor, $(Q-\Delta Q_{motor})$ is the discharge amount and $L_f$ is the disk friction power including a power due to said reverse flow in said impeller inlet.

* * * * *